US007819444B2

(12) United States Patent
Kagawa et al.

(10) Patent No.: US 7,819,444 B2
(45) Date of Patent: Oct. 26, 2010

(54) HANDLE APPARATUS

(75) Inventors: Takahiro Kagawa, Yokohama (JP); Keita Abe, Atsugi (JP)

(73) Assignees: Alpha Corporation, Yokohama-shi, Kanagawa (JP); Nissan Motor Co., Ltd., Yokohama-shi, Kanagawa (JP)

( * ) Notice: Subject to any disclaimer, the term of this patent is extended or adjusted under 35 U.S.C. 154(b) by 5 days.

(21) Appl. No.: 12/124,621

(22) Filed: May 21, 2008

(65) Prior Publication Data

US 2008/0290671 A1 Nov. 27, 2008

(30) Foreign Application Priority Data

May 22, 2007 (JP) ..... 2007-135649

(51) Int. Cl.
*E05B 3/00* (2006.01)

(52) U.S. Cl. ..... 292/336.3; 292/DIG. 65; 292/DIG. 31

(58) Field of Classification Search ..... 292/336.3, 292/348, 347, 354, 356, DIG. 27, DIG. 30, 292/DIG. 31, DIG. 65
See application file for complete search history.

(56) References Cited

U.S. PATENT DOCUMENTS

| | | | | |
|---|---|---|---|---|
| 5,941,104 | A * | 8/1999 | Sadler | 70/208 |
| 6,513,353 | B1 * | 2/2003 | Weinerman et al. | 70/208 |
| 6,651,467 | B1 * | 11/2003 | Weinerman et al. | 70/208 |
| 7,059,641 | B2 * | 6/2006 | Chanya | 292/336.3 |
| 7,237,411 | B2 * | 7/2007 | Pantke et al. | 70/208 |
| 7,497,488 | B2 * | 3/2009 | Chen | 292/216 |

FOREIGN PATENT DOCUMENTS

JP 6-23658 6/1994

* cited by examiner

*Primary Examiner*—Peter M. Cuomo
*Assistant Examiner*—Mark Williams
(74) *Attorney, Agent, or Firm*—Drinker Biddle & Reath LLP

(57) ABSTRACT

A handle apparatus is provided with: a handle base fixed to a door of a vehicle; a swing lever held inside the door and connected to the handle base to be vertically rotatable; a handle main body including an operation arm inserted inside the door through an arm insertion hole to drive the swing lever; a blocking piece on the swing lever for blocking the arm insertion hole from an inside of the door; and a rising piece protruding from a side edge of the blocking piece toward an outside of the door.

5 Claims, 5 Drawing Sheets

HANDLE APPARATUS

This application claims foreign priority from Japanese Patent Application No. 2007-135649 filed on May 22, 2007, the entire contents of which are hereby incorporated by reference.

BACKGROUND OF THE INVENTION

1. Field of the Invention

The present invention relates to a handle apparatus.

2. Related Art

JP-Y-06-023658 discloses a handle apparatus in which a door lock apparatus is operated by an operation to a handle main body. The handle apparatus is configured such that the handle main body is connected to a bracket (handle base). The handle main body includes an arm which is inserted into a rear surface of the handle base through an opening (arm insertion hole) formed through the handle base. Also, the handle base includes a swing lever which is driven to rotate by a rotation of the arm in accordance with a rotation of the handle main body.

A flat plate-like blocking portion extends from the front end of the rotating swing lever. When the swing lever moves to an operational rotation position, the blocking portion moves to a rear surface of the arm insertion hole. In this state, the arm insertion hole is blocked by the blocking portion, thereby preventing a case in which a tool or the like is inserted from an outside of the door into the arm insertion hole to illegally operate components disposed inside the door.

However, in the above handle apparatus, when a gap formed between the blocking portion and an opening end of the arm insertion hole is wide, a tool or the like may be inserted into a path formed in a slant direction so that a problem may arise in that a desired object may not be achieved. Such problem may be solved a little by arranging the blocking portion close to the opening end of the arm insertion hole. However, since the swing lever as a movable member may interferes with other components like the handle base when they move, an another problem would arise in that a degree of freedom in design of a whole handle apparatus decreases by adding structures to the flat plate-like blocking portion having a predetermined area.

Additionally, since the blocking portion is formed into a flat plate shape, a problem may arise in that the front end of the tool or the like is inserted along the blocking portion and the blocking portion is used as a guide when searching the insertion hole.

SUMMARY OF THE INVENTION

One or more embodiments of the invention provide a handle apparatus adapted to surely prevent an illegal operation through an arm operation hole without decreasing a degree of freedom in design.

In accordance with one or more embodiments of the invention, a handle apparatus is provided with: a handle base (3) fixed to a door (2) of a vehicle which is maintained in a closed state while being restrained by a door lock apparatus (1); a swing lever (4) held inside the door (2) and connected to the handle base (3) to be vertically rotatable, a door restraining release operation of the door lock apparatus (1) being carried out by rotating the swing lever (4) from an initial rotation position to an operational rotation position; a handle main body (7) connected to the handle base (3) to be pulled up from an initial rotation position to an operational rotation position and including an operation arm (5) inserted inside the door (2) through an arm insertion hole (6) to drive the swing lever (4) to the operational rotation position when the handle main body (7) is pulled up; a blocking piece (8) that is provided on the swing lever (4) and moves to a rear side of the arm insertion hole (6) when the swing lever (4) is located in the operational rotation position so as to block the arm insertion hole (6) from an inside of the door (2); and a rising piece (11) protruding from a side edge of the blocking piece (8) toward an outside of the door (2) so as to narrow a path (10) from the outside of the door through a gap between the arm insertion hole (6) and the blocking piece (8) to a position around a cylinder lock (9) for locking or unlocking the door lock apparatus (1) when the handle main body (7) is rotated to the operational rotation position.

In the handle apparatus, a blocking wall (12) may erect from the handle base (3) along the rising piece (11) of the swing lever (4) located in the operational rotation position. A base end of the blocking wall (12) may be positioned in a direction of a free end of the rising piece (11).

In the handle apparatus, the rising piece (11) may overlap with the blocking wall (12) in a height direction to completely block the path (10).

In the handle apparatus, an escutcheon portion (14) may be provided on the handle base (3) and disposed on an outer panel (13) of the door (2) to form an outer surface of the door (2). The operation arm (5) may be inserted through the arm insertion hole (6) formed on the escutcheon portion (14) and connected to a hinge arm (15) formed in a rear surface of the escutcheon portion (14). The cylinder lock (9) may be fixed to a cylinder fixed portion (16) formed in the rear surface of the escutcheon portion (14).

According to one or more embodiments of the invention, a handle apparatus includes a handle main body 7 which is rotatably connected to a handle base 3 fixed to a door 2 of a vehicle. The handle main body 7 includes an operation arm 5 which is inserted into the inside of the door 2 through an arm insertion hole 6. Also, a swing lever 4 is rotatably connected to the handle base 3 and thus the swing lever 4 is driven to rotate from an initial rotation position to an operational rotation position when the handle main body 7 is pulled up while being attached to the door 2.

The swing lever 4 is connected to the door lock apparatus 1 through appropriate transmission members such as a rod and a wire. When the swing lever 4 is rotated to the operational rotation position, a door lock apparatus 1 releases a restraining operation of the door 2, and thus it is possible to open the door 2.

The door lock apparatus 1 is connected to a cylinder lock 9 through the appropriate transmission members so as to switch between lock/unlock states, and the cylinder lock 9 can release the door lock apparatus 1 only in the unlock state.

When the handle main body 7 is pulled up, the arm insertion hole 6 covered by a handle portion 17 of the handle main body 7 is exposed to the outside, and thus a tool or the like can be inserted into a gap formed between the arm insertion hole 6 and the operation arm 5 of the handle main body 7. If the gap is formed into a linear shape around the cylinder lock 9 or communicates with a path 10 with a crank shape, for example, the tool may move along the path 10 to separate the transmission members connected to the door lock apparatus 1 or to perform an illegal operation such as a compulsory driving operation of a connection portion of the transmission members.

A blocking piece 8 and a rising piece 11 formed in the swing lever 4 block the path 10 to prevent the illegal unlock operation of the door 2. The blocking piece 8 is located at a position in rear of the arm insertion hole 6 when the handle main body 7 is pulled up, that is, the swing lever 4 is rotated to the operational rotation position. Then, the blocking piece 8 blocks the path 10 which is inserted through the arm insertion hole 6 and reaches the inside of the door 2 in a front view. On the contrary, the rising piece 11 is configured such that a side edge of the blocking piece 8 is bent to the outside of the door 2 to narrow a gap formed between the side edge of the blocking piece 8 and the end edge of the arm insertion hole 6.

Accordingly, in the embodiments of the invention, since the blocking piece 8 and the rising piece 11 prevent a tool from being inserted into the inside of the door 2 through the arm insertion hole 6, it is not necessary to approach the blocking piece 8 to the opening end of the arm insertion hole 6 in the operational rotation position. For this reason, since it is not necessary to set an operational region of the blocking piece 8 to a surface close to the opening end of the arm insertion hole 6, a degree of freedom in arrangement of the blocking piece 8 increases, thereby easily performing a design thereof in consideration of interference with other components.

Further, since the operation surface of the blocking piece 8 is disposed away from the opening end of the arm insertion hole 6, it is possible to dispose a protrusion in a surface of the blocking piece 8 opposed to the arm insertion hole 6. As a result, for example, as shown in the drawing, since it is possible to use the blocking piece 8 as a connection portion of the transmission members with respect to the door lock apparatus 1, it is possible to efficiently use a space compared with the known example in which a surface of the blocking piece 8 opposed to the arm insertion hole 6 needs to be formed into a flat surface as a whole.

Furthermore, since the rising piece 11 erecting from the side edge of the blocking piece 8 serves as a regulation wall for preventing a case in which a tool moves along the blocking piece 8 while pressing against the front end of the blocking piece 8 so as to search the insertion path 10 to a position around the cylinder lock 9, it is possible to prevent an illegal operation.

Moreover, since when a blocking wall 12 erects from the handle base 3 so as to be positioned along the rising piece 11 of the swing lever 4 located in the operational rotation position, the blocking wall 12 serves as a wall for preventing a case in which a tool moves while sliding on the wall of the handle base 3 to the path 10 around the cylinder lock 9, it is possible to further prevent an illegal operation.

The handle apparatus may be configured as an assembly in which the handle main body 7, the cylinder lock 9, and the like are fixed to the handle base 3 or may be configured such that they are connected to each other through the door 2. When the whole handle apparatus is configured as an assembly, the handle base 3 can be provided with an escutcheon portion 14 which is disposed in an outer panel 13 of the door 2 in the handle base 3 to form an outer surface of the door 2. Accordingly, the handle apparatus is attached to the door 2 in the manner that the escutcheon portion 13 blocks an attachment hole 13*a* formed through the outer panel 13 of the door 2.

In addition, when the respective components are connected to one another through the door 2, the handle portion 17 of the handle main body 7 is exposed from the outer surface of the door 2 and the operation arm 5, which is inserted into the inside of the door 2 through the arm insertion hole 6 formed through the outer panel 13 of the door 2, is connected to the handle base 3 fixed to the inside of the door 2.

According to the embodiments of the invention, it is possible to surely prevent an illegal operation through an arm insertion hole without decreasing a degree of freedom in design.

Other aspects and advantages of the invention will be apparent from the following description, the drawings and the claims.

DETAILED DESCRIPTION OF THE EXEMPLARY EMBODIMENTS

Figure 1A:
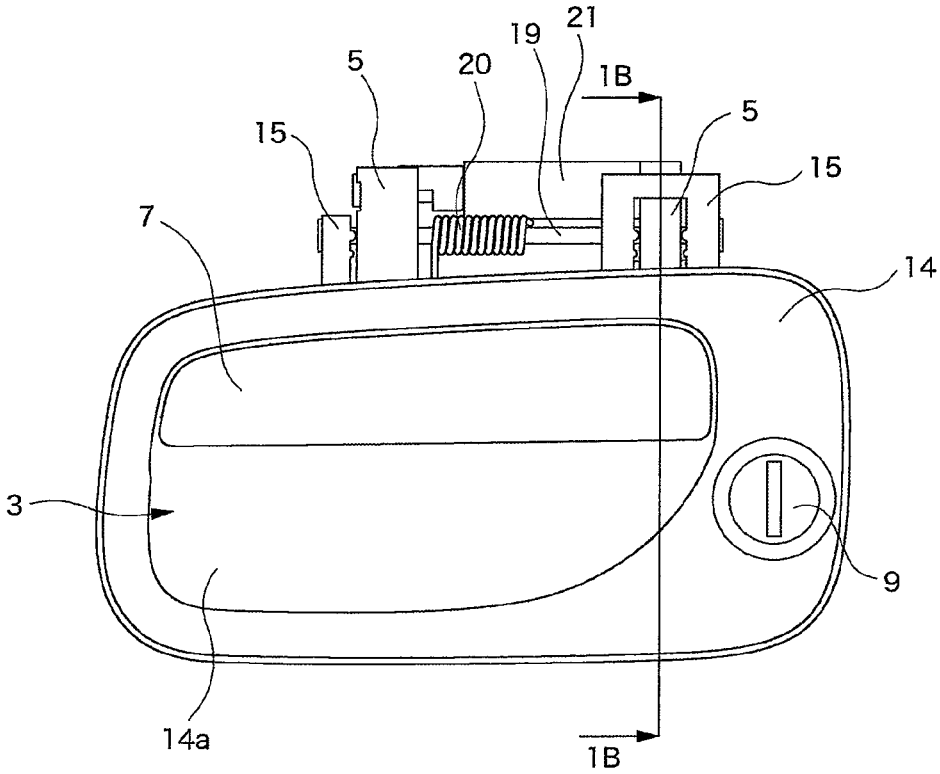
FIG. 1(*a*) is a front view of a handle apparatus of an exemplary embodiment, and FIG. 1(*b*) is a sectional view taken along the line 1B-1B in FIG. 1(*a*).
Figure 1B:
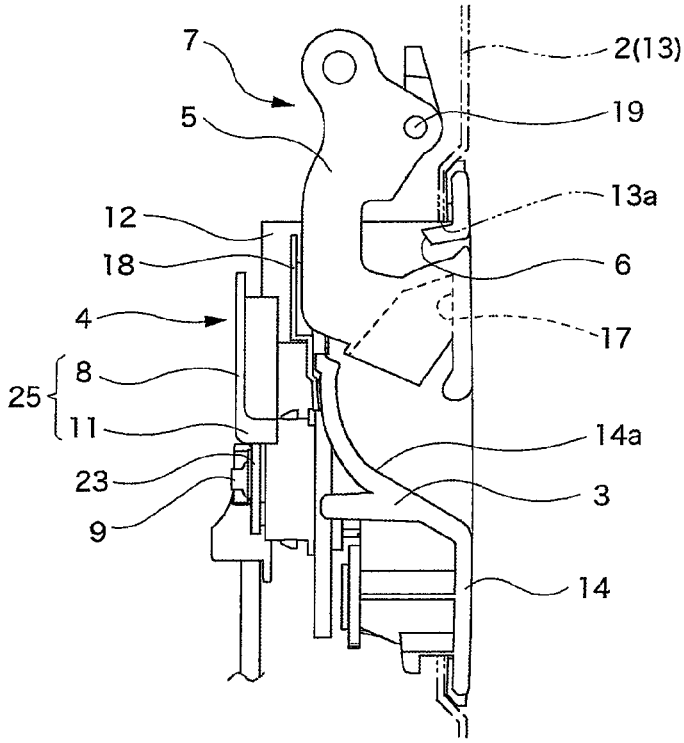

An exemplary embodiment of the invention will be described below in detail with reference to the accompanying drawings. As shown in FIGS. 1(*a*) and 1(*b*), a handle apparatus is configured such that a handle main body 7 is connected to a handle base 3, and the handle base 3 is fixed to a vehicle door 2 as shown in the drawing. A handle attachment hole 13*a* is formed through an outer panel 13 of the vehicle door 2 so that the handle apparatus is fixed thereto by inserting the handle apparatus therethrough from the outside of the vehicle door 2. Also, an escutcheon portion 14 is formed in the handle base 3 so as to block the handle attachment hole 13*a*. An end cover 18 is mounted between the escutcheon portion 14 and the outer panel 13.

The handle main body 7 includes two operation arms 5 which are formed in the rear surface of a handle portion 17 in a protruding manner. In order to expose only the handle portion 17 from the outer surface of the vehicle door 2, each of the operation arms 5 is inserted into the inside of the vehicle door 2 through the arm insertion hole 6 formed through the handle base 3 and is vertically rotatably connected to each of hinge arms 15 which are formed in the rear surface of the escutcheon portion 14 of the handle base 3 in a protruding manner. A handle concave portion 14*a* is formed in the escutcheon portion 14 so as to provide a handle base to the handle portion 17 of the handle main body 7.

Figure 3A:
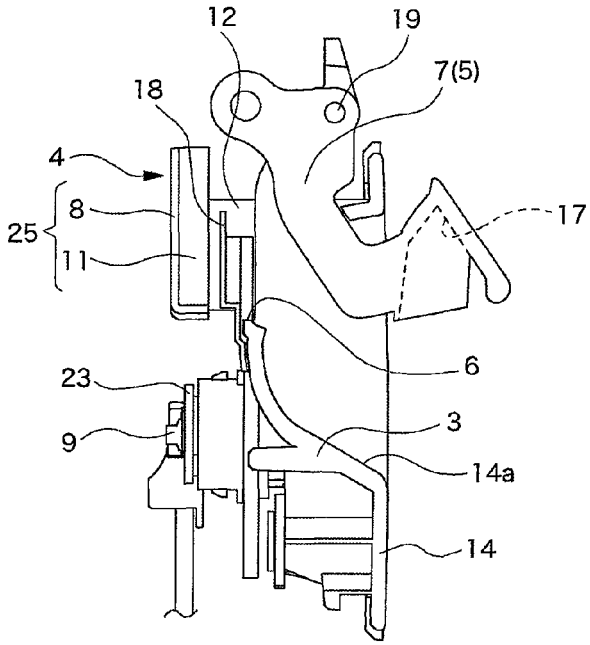
FIG. 3(*a*) is a view illustrating a state where the handle main body is pulled up, FIG. 3(*b*) is a sectional view taken along the line 3B-3B shown in FIG. 2 in the state where the handle main body is located in an initial rotation position, and FIG. 3(*c*) is a view corresponding to FIG. 3(*b*) in the state where the handle main body is pulled up.
Figure 3B:
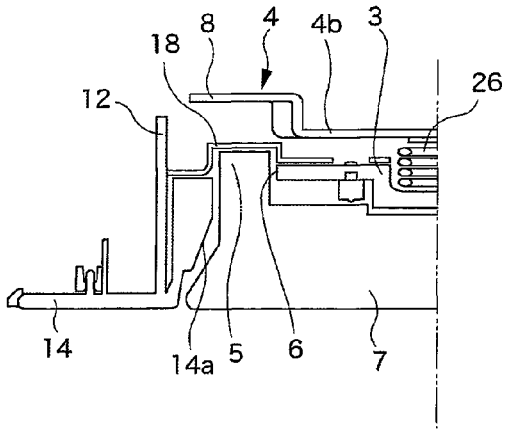
Figure 3C:
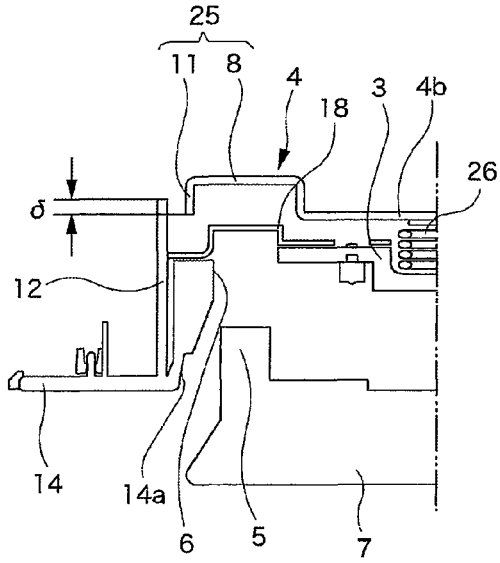

The handle main body 7 is rotatable from an initial rotation position in which the handle portion 17 is positioned along the surface of the escutcheon portion 14, that is, the surface of the outer panel 13 of the vehicle door 2 as shown in FIG. 1(*b*) to an operational rotation position in which the handle portion 17 is pulled up to be rotated upward as shown in FIG. 3(*a*). At this time, the handle main body 7 is urged to the initial rotation position by a torsion spring 20 wound around a support shaft 19 which connects the operation arms 5 to the hinge arms 15. Additionally, a counter weight 21 having a predetermined weight is fixed between the two operation arms 5, thereby preventing operating force from being generated by inertia with respect to the handle main body 7 toward the operational rotation position.

Figure 2:
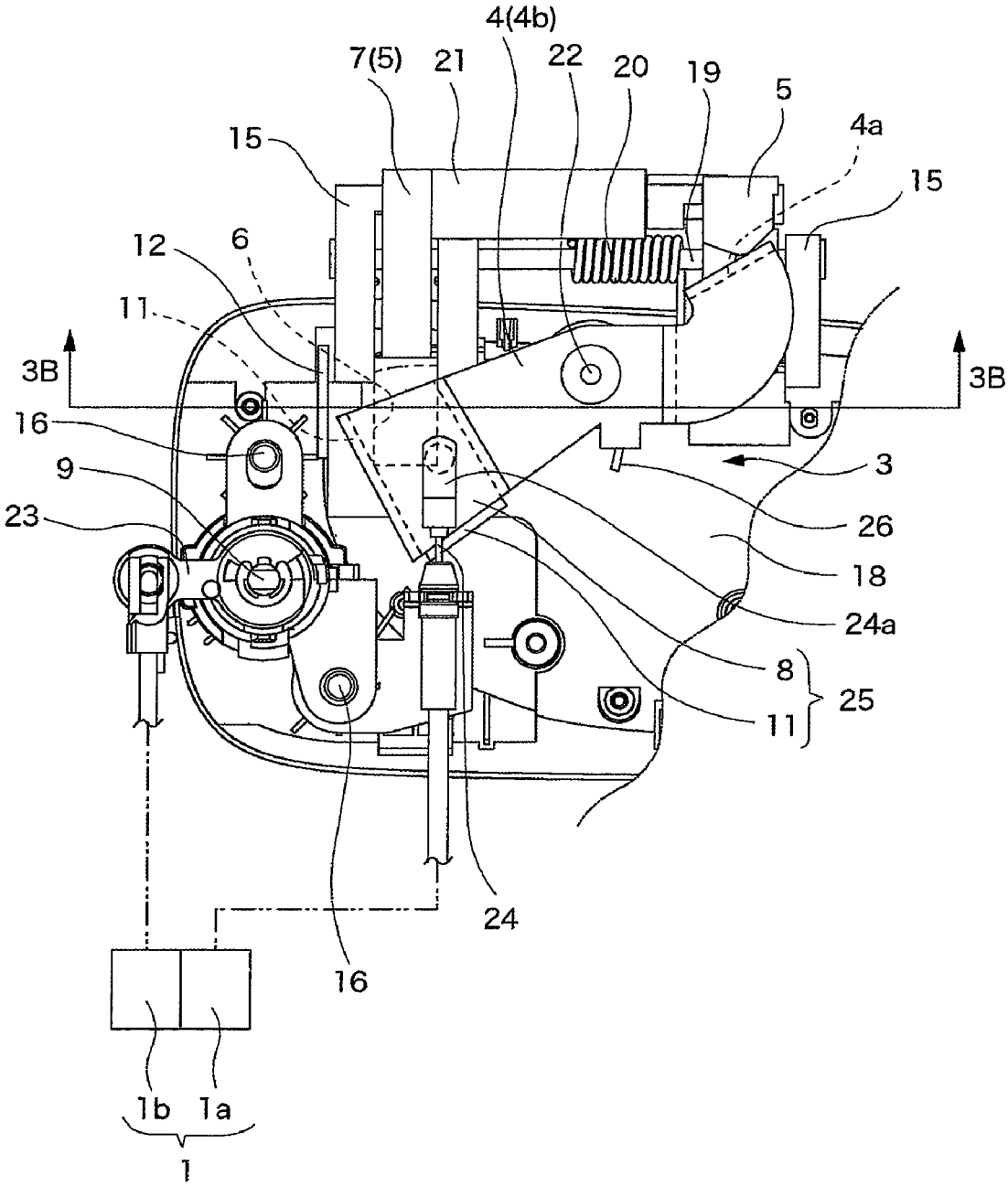
FIG. 2 is a rear view illustrating the handle apparatus.
Figure 4A:
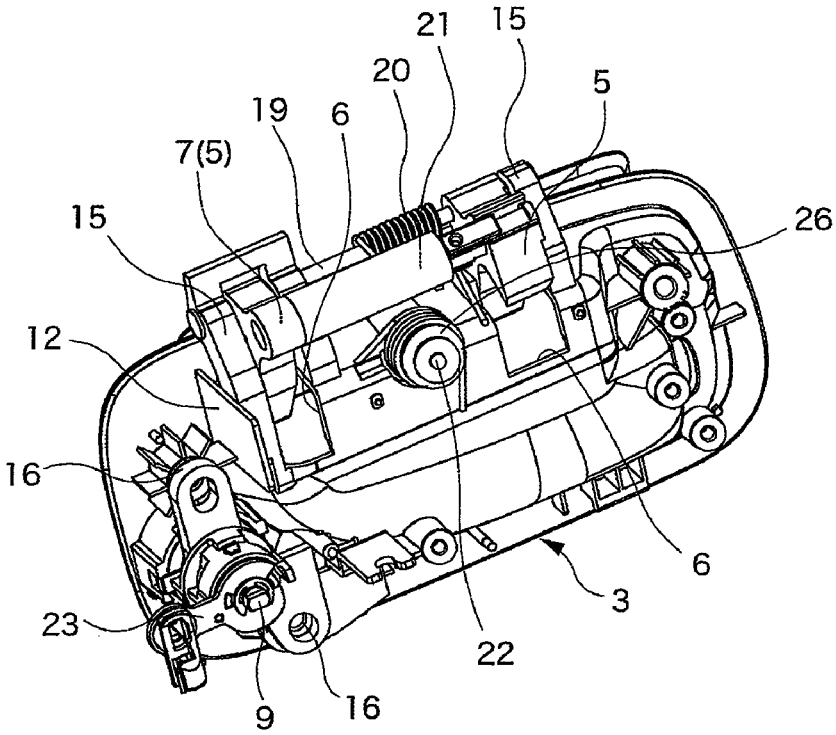
FIG. 4(*a*) is a perspective view of the handle apparatus when viewed from the opposite side, and FIG. 4(*b*) is a rear view.
Figure 4B:
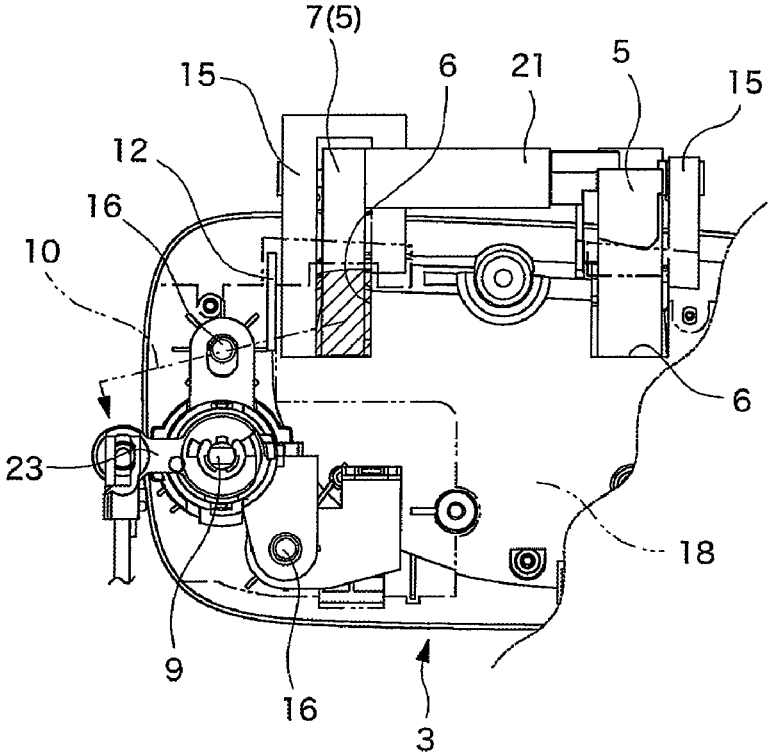
Figure 5:
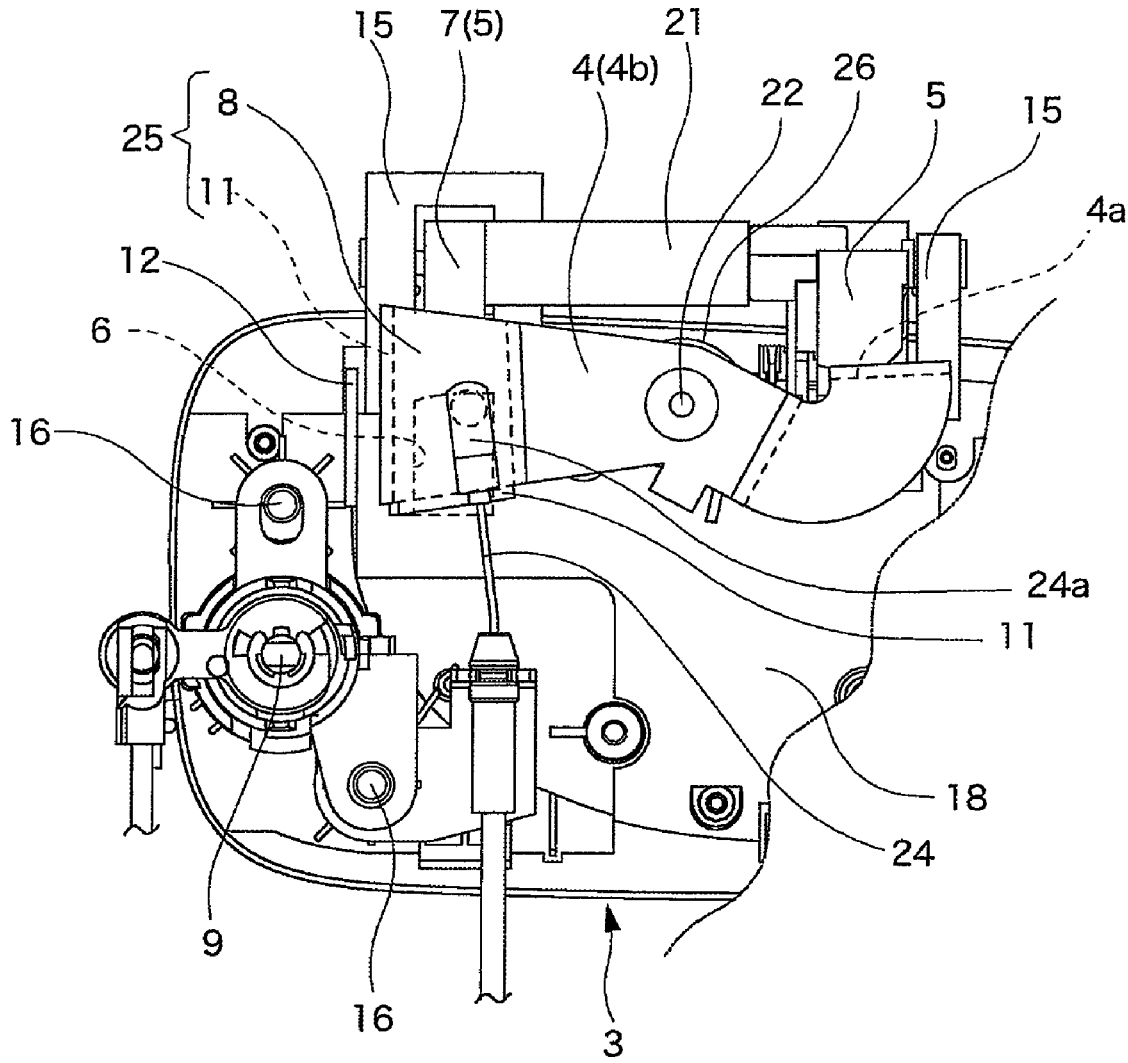
FIG. 5 is a rear view illustrating a state where the handle main body is pulled up.

Reference Numeral 4 denotes a swing lever connected to the rear surface of the escutcheon portion 14 and rotates vertically about a pivot 22 from the initial rotation position shown in FIG. 2 to the operational rotation position shown in FIG. 5. As shown in FIG. 4(*a*), a torsion spring 26 is wound around the pivot 22 so as to urge the swing lever 4 to the initial rotation position. The swing lever 4 includes an interference piece 4*a* with respect to the operation arm 5 of the handle main body 7 and the interference piece 4*a* is driven when the handle main body 7 is rotated to the operational rotation position.

Reference Numeral 9 denotes a cylinder lock held in the escutcheon portion 14 and the cylinder lock is connected to a cylinder lever 23 which is rotated by an unlock key (not shown). Since a fitting work (panel passing work) is easy in that the rear surface of the handle base 3 is inserted into the handle attachment hole 13*a* of the outer panel 13, in this exemplary embodiment, the cylinder lock 9 is fixed to a cylinder fixed portion 16 of the escutcheon portion 14 from the inside of the vehicle door 2 after the handle base 3 is inserted through the handle attachment hole 13*a*.

After the handle apparatus is fixed to the vehicle door 2, the swing lever 4 is connected to a latch operation portion 1*a* of the door lock apparatus 1 through a cable 24 and then the cylinder lever 23 is connected to a lock/unlock operation portion 1*b* of the door lock apparatus 1. When the swing lever 4 moves to the operational rotation position in this state, a latch (not shown), which restrains the vehicle door 2 to maintain a closed state, is released, and thus it is possible to open the vehicle door 2. Additionally, when the cylinder lock 9 is locked, the lock/unlock operation portion 1*b* transits from the unlock state to the lock state, and thus it is not possible to release the latch operation using the latch operation portion 1*a*.

As shown in FIGS. 3(*a*) and 4, when the handle main body 7 is pulled up to be rotated to the operational rotation position, a large gap is formed in a backside of the operation arms 5 of the handle main body 7. At this time, the end cover 18, which blocks the gap in appearance, can be easily broken by a breaking operation. When the end cover 18 is broken, for example, a tool may be inserted through the gap and moved along a path 10 around the cylinder lock 9 indicated by the dashed line shown in FIG. 4(*b*). When the tool is inserted into a position around the cylinder lock 9, a problem arises in that the door lock apparatus 1 may be illegally unlocked. Accordingly, a blocking portion 25 and a blocking wall 12 are disposed therein so as to block or narrow the path 10.

As shown in FIGS. 2, 3(*a*), 3(*b*) and 3(*c*), the blocking portion 25 includes a blocking piece 8 formed in the swing lever 4 and a rising piece 11 erecting from a side edge of the blocking piece 8. The blocking piece 8 extends to a connection piece 4*b* by the pivot 22 of the swing lever 4 and is formed into a flat plate which is perpendicular to the rotation center. As shown in FIG. 5, the blocking piece 8 is formed in a position and has a size which overlaps with the arm insertion hole 6 in a front view when the swing lever 4 moves to the operational rotation position.

Additionally, in order to efficiently use a space in the rear surface of the handle base 3, the blocking piece 8 is commonly used as an attachment piece of the cable 24 which connects the swing lever 4 to the door lock apparatus 1. In order to prevent an interference between an attachment portion 24*a* of the cable 24 which protrudes to the rear-surface wall of the handle base 3 and the rear-surface wall of the handle base 3, the connection piece 4*b* is bent backward and a movable space of the attachment portion 24*a* is ensured between the blocking piece 8 and the rear surface of the handle base 3.

Meanwhile, the rising piece 11 erects from the side edge of the blocking piece 8, which is substantially formed in a rectangular shape in a front view, to the outer surface of the vehicle door 2. The rising piece 11 is formed therein so as to narrow the tool insertion path 10 together with the blocking piece 8. At this time, the rising piece 11 is formed in a position in which the tool insertion path 10 is efficiently blocked. In this embodiment, supposing that the path 10 shown in FIG. 4(*b*) is the tool insertion path 10, as shown in FIG. 5, the rising piece 11 is formed in two sides facing the cylinder lock 9 when the swing lever 4 moves to the operation rotation position.

As shown in FIGS. 3(*b*) and 3(*c*), the blocking wall 12 protrudes from the rear surface of the escutcheon portion 14 to the inside of the vehicle door 2. As shown in FIG. 3(*c*), the blocking wall 12 has a height dimension which inwardly overlaps (at overlap margin δ) with the rising piece 11 of the swing lever 4 when the swing lever 4 moves to the operational rotation position. Also, the blocking wall 12 is disposed along the rising piece 11 in the operation rotation position, thereby completely blocking the tool insertion path 10.

The blocking wall 12 erecting from the rear surface of the handle base 3 does not deteriorate the panel passing work of the handle apparatus. Also, the blocking wall 12 is disposed in a position which can efficiently block the tool insertion hole 10. In this embodiment, it is the most important to block the path 10 shown in FIG. 4(*b*). Accordingly, as shown in FIG. 5, the blocking wall 12 is disposed in a position corresponding to one side of the rising piece 11 of the swing lever 4.

While description has been made in connection with embodiments of the present invention, it will be obvious to those skilled in the art that various changes and modification may be made therein without departing from the present invention. It is aimed, therefore, to cover in the appended claims all such changes and modifications falling within the true spirit and scope of the present invention.

DESCRIPTION OF REFERENCE NUMERALS AND SIGNS

1: DOOR LOCK APPARATUS
2: DOOR
3: HANDLE BASE
4: SWING LEVER
5: OPERATION ARM
6: ARM INSERTION HOLE
7: HANDLE MAIN BODY
8: BLOCKING PIECE
9: CYLINDER LOCK
10: PATH
11: RISING PIECE
12: BLOCKING WALL
13: OUTER PANEL
14: ESCUTCHEON PORTION
15: HINGE ARM
16: CYLINDER FIXED PORTION

What is claimed is:

1. A handle apparatus configured to cooperate with a door of a vehicle, the door having an inner surface facing an interior of the vehicle, an outer surface facing an exterior of the vehicle, and a door inside disposed between the inner surface and the outer surface, the handle apparatus comprising:

a handle base configured to be fixed to the door of a vehicle which is maintained in a closed state while being restrained by a door lock apparatus;

a swing lever configured to be held in the door inside and connected to the handle base to be vertically rotatable, a door restraining release operation of the door lock apparatus being carried out by rotating the swing lever from an initial rotation position to an operational rotation position;

a handle main body connected to the handle base to be pulled up from an initial rotation position to an operational rotation position, the handle main body including a grip portion and a pair of pivotal arms, one of the pivotal arms being an operation arm configured to be inserted to the door inside through an arm insertion hole to drive the swing lever to the operational rotation position when the grip portion is pulled up, the arm insertion hole defining an opening between the exterior of the vehicle and the door inside;

a blocking piece that is provided on the swing lever and moves to a rear side of the arm insertion hole when the swing lever is located in the operational rotation position so as to block the arm insertion hole from the door inside; and a rising piece protruding from a side edge of the blocking piece toward the outer surface of the door so as to narrow a path from the exterior of the vehicle through a gap between the arm insertion hole and the blocking piece to a position around a cylinder lock for locking or unlocking the door lock apparatus when the handle main body is rotated to the operational rotation position, so as to prevent unauthorized insertion of a tool to unlock the door lock apparatus when the swing lever is located in the operational rotation position.

2. The handle apparatus according to claim 1, further comprising:

a blocking wall erected from the handle base, the blocking wall being disposed along the rising piece of the swing lever when the swing lever is in the operational rotation position, a base end of the blocking wall being positioned in a direction of a free end of the rising piece.

3. The handle apparatus according to claim 2, wherein the rising piece overlaps with the blocking wall in a height direction to completely block the path.

4. The handle apparatus according to claim 1, further comprising:

an escutcheon portion provided on the handle base and configured to be disposed on an outer panel of the door to form the outer surface of the door, wherein the operation arm is inserted through the arm insertion hole formed on the escutcheon portion and connected to a hinge arm formed in a rear surface of the escutcheon portion, and wherein the cylinder lock is fixed to a cylinder fixed portion formed in the rear surface of the escutcheon portion.

5. A handle apparatus configured to cooperate with a door, comprising:

a handle base including a first surface and a second surface on an opposite side of the first surface;

an arm insertion hole penetrating through the handle base from the first surface to the second surface;

a handle main body including a grip portion disposed on a side of the first surface of the handle base and a pair of pivotal arms, one of the pivotal arms being an operation arm penetrating through the arm insertion hole from the side of the first surface of the handle base to a side of the second surface of the handle base;

a swing lever disposed on the side of the second surface of the handle base;

a blocking piece provided on the swing lever; and a rising piece provided on the blocking piece and protruding from the blocking piece toward the handle base in a direction from the second surface to the first surface, wherein the grip is configured to be pulled up from an initial rotation position to an operational rotation position, wherein the operation arm is configured to transmit a motion of the grip portion to drive the swing lever so that the swing lever rotates from an initial rotation position to an operational rotation position when the grip portion is pulled up from the initial rotation position to the operational rotation position, wherein the blocking piece is configured to overlap with the arm insertion hole in the direction from the second surface to the first surface so as to block the arm insertion hole from the side of the second surface of the handle base, and wherein the rising piece prevents unauthorized insertion of a tool to unlock the door, when the swing lever positions on the operational rotation position.

* * * * *